US010957965B2

(12) United States Patent
Angevain et al.

(10) Patent No.: US 10,957,965 B2
(45) Date of Patent: Mar. 23, 2021

(54) DIRECTIONAL COUPLER AND A METHOD OF MANUFACTURING THEREOF

(71) Applicant: EUROPEAN SPACE AGENCY (ESA), Paris (FR)

(72) Inventors: Jean-Christophe Angevain, Leiden (NL); Nelson Fonseca, Noordwijk (NL)

(73) Assignee: EUROPEAN SPACE AGENCY (ESA), Paris (FR)

( * ) Notice: Subject to any disclaimer, the term of this patent is extended or adjusted under 35 U.S.C. 154(b) by 0 days.

(21) Appl. No.: 16/468,493

(22) PCT Filed: Nov. 30, 2017

(86) PCT No.: PCT/EP2017/081060
§ 371 (c)(1),
(2) Date: Jun. 11, 2019

(87) PCT Pub. No.: WO2018/108557
PCT Pub. Date: Jun. 21, 2018

(65) Prior Publication Data

US 2020/0091577 A1 Mar. 19, 2020

(30) Foreign Application Priority Data

Dec. 12, 2016 (EP) ..... 16203470

(51) Int. Cl.
*H01P 5/18* (2006.01)
*H01P 5/04* (2006.01)
(Continued)

(52) U.S. Cl.
CPC ..... *H01P 5/182* (2013.01); *H01P 1/171* (2013.01); *H01P 11/002* (2013.01)

(58) Field of Classification Search
CPC .. H01P 5/18; H01P 5/181; H01P 5/182; H01P 11/001; H01P 5/04
(Continued)

(56) References Cited

U.S. PATENT DOCUMENTS 2,701,340 A 2/1955 Miller
2,739,287 A * 3/1956 Riblet ..... H01P 5/182 333/113
(Continued)

FOREIGN PATENT DOCUMENTS

CN 201210512 3/2009
GB 1020484 7/1962

OTHER PUBLICATIONS

Rajeek et al, "Analysis of a Wide Compound Slot-Coupled Parallel Waveguide Coupler and Radiator," IEEE Transactions on Microwave Theory and Techniques, vol. 43, No. 4, pp. 802-809, Apr. 1995.
(Continued)

*Primary Examiner* — Dean O Takaoka
(74) *Attorney, Agent, or Firm* — Nixon & Vanderhye P.C.

(57) ABSTRACT

A directional coupler (100) comprises two hollow bodies (200, 201) forming two waveguide portions. Each hollow body has an open end arranged at a first side (10) of the hollow body and another open end arranged at a second side (20) of the hollow body opposite to the first side in a longitudinal direction (30) of the hollow body. The hollow body has a first cross section perpendicular to the longitudinal direction. A second cross section along the longitudinal direction defines a first plane of propagation of the electric field. The two waveguide portions have a common wall along the longitudinal direction (30) forming a septum (400) between the two waveguide portions on a second plane orthogonal to the first plane. The septum has an aperture (410) for coupling the two waveguide portions. The aperture
(Continued)

has a shape comprising a part (420) slanted with respect to the longitudinal direction.

15 Claims, 10 Drawing Sheets

(51) Int. Cl.
*H01P 1/17* (2006.01)
*H01P 11/00* (2006.01)

(58) Field of Classification Search
USPC ..... 333/113
See application file for complete search history.

(56) References Cited

U.S. PATENT DOCUMENTS 3,063,025 A * 11/1962 Van Atta ..... H01Q 25/02 333/137
3,201,715 A * 8/1965 Breese ..... H01P 1/161 333/1.1
3,238,473 A 3/1966 Salzberg
3,758,879 A * 9/1973 Beguin ..... H01P 5/04 333/111
3,914,713 A * 10/1975 Konishi ..... H01P 1/00 333/21 R
3,958,192 A 5/1976 Rootsey
4,679,011 A * 7/1987 Praba ..... H01P 5/182 333/111
4,792,770 A * 12/1988 Parekh ..... H01P 5/16 333/113
4,812,788 A 3/1989 Wong et al.
5,247,268 A * 9/1993 Meise ..... H01P 5/04 333/111
5,874,867 A 2/1999 Oguma et al.
6,377,133 B1 4/2002 Ihmels et al.
9,147,921 B2 9/2015 Delgado

OTHER PUBLICATIONS

Zhong et al, "An Efficient Integral Equation Analysis of Waveguide Slot Coupling," Asia Pacific Microwave Conference, Shanghai, China, pp. 989-992, 1997.
Tiwari et al, "Centered Inclined Slot Coupling Between Waveguides with Coplanar Axes," International Journal of RF and Microwave Computer-Aided Engineering/vol. 21, No. 1, Jan. 2011, Wiley Periodicals, Inc., 2010, pp. 52-58.
Zhou, et al, "Compact, Lightweight and Wideband Directional Waveguide Coupler Implemented with 3D Direct-Metal-Laser-Sintering Technique," Temasek Laboratories, University of Singapore, Singapore, 2016.
Sieverding et al, "Modal Analysis of Parallel and Crossed Rectangular Waveguide Broadwall Couplers with Apertures of Arbitrary Shape," Microwave Department, University of Bremen, Germany, pp. 1559-1562, IEEE, 1997.
Ali et al., "Novel Multi-Layer SIW Broadband Coupler for Nolen Matrix Design in Ku Band", Antennas and Propagation Society International Symposium, IEEE, Jul. 5, 2008, pp. 1-4.
Deslandes et al., "Integrated Microstrip and Rectangular Waveguide in Planar Form", IEEE Microwave and Wireless Components Letters, vol. 11, No. 2, Feb. 1, 2001, pp. 68-70.
Guntupalli et al., "Ultra-Compact Millimeter-Wave Substrate Integrated Waveguide Crossover Structure Utilizing Simultaneous Electric and Magnetic Coupling", Microwave Symposium Digest (MTT), 2012, IEEE MTT-S International, Jun. 17, 2012, pp. 1-3.
Hernández-López et al., "Coupling and Radiation Through "V-Shaped" Narrow Slots Using the FDTD Method", IEEE Transactions on Antennas and Propagation, vol. 49, No. 10, Oct. 1, 2001, pp. 1363-1369.
Xin et al., "A Terahertz-band E-plane Waveguide Directional Coupler With Broad Bandwidth", 16$^{th}$ International Conference on Electronic Packaging Technology, 2015, pp. 1419-1421.
International Search Report and Written Opinion of the ISA for PCT/EP2017/081060 dated May 2, 2018, 18 pages.
R. Beyer et al, *Compact Top-Wall Hybrid/Coupler Design for Extreme Broad Bandwidth Applications*, IEEE (2005).

* cited by examiner

DIRECTIONAL COUPLER AND A METHOD OF MANUFACTURING THEREOF

This application is the U.S. national phase of International Application No. PCT/EP2017/081060 filed Nov. 30, 2017 which designated the U.S. and claims priority to EP 16203470.6 filed Dec. 12, 2016, the entire contents of each of which are hereby incorporated by reference.

FIELD OF THE INVENTION

The invention relates to a directional coupler, a radio frequency network comprising the directional coupler and a method of manufacturing the directional coupler.

BACKGROUND

Directional couplers are common components in waveguide networks for coupling electromagnetic signals between various ports of the waveguide networks with low insertion losses.

Directional couplers used in space applications are mainly manufactured with conventional milling manufacturing techniques because these techniques can provide high precision for manufacturing components at high frequencies such as millimeter and sub-millimeter frequencies. In order to facilitate assembly of the directional couplers, said directional couplers are typically manufactured by separately milling two solid half bodies. After milling, common joining walls are formed in the half bodies. The common joining walls define a plane of propagation of the electric field called E-plane. The two separated milled half bodies are then assembled together by putting in contact the two common joining walls for forming a so-called E-plane waveguide directional coupler having two coupled rectangular waveguide portions. In an assembled E-plane waveguide directional coupler, coupling between the two rectangular waveguide portions occurs through a broad wall common to both waveguide portions. The E-plane is parallel to narrow walls of each rectangular waveguide portion and ideally cuts in two identical parts the waveguide directional coupler at the middle point between said narrow walls. The E-plane does not intersect the electromagnetic surface current lines resulting from a waveguide fundamental mode excitation. As a consequence, imprecisions of manufacturing and assembly along the joining walls, i.e. along the E-plane, disturb less the circulation of said surface currents and minimize undesired effects such as leakage and passive intermodulation products. Thus, typically, E-plane waveguide directional couplers are preferred type of couplers in space applications as well as other applications requiring for example high power handling and multi-carrier operation.

There are two main families of known E-plane waveguide directional couplers: the so-called branch line waveguide couplers and the so-called slot waveguide couplers.

A branch line waveguide coupler may comprise two waveguide portions assembled together along the E-plane as described above. The waveguide portions are electromagnetically coupled together by means of multiple small waveguide sections, called branches, extending in a direction along the E-plane. Performance of the branch line couplers can be tuned by adjusting the number and dimensions of the said branches.

The slot waveguide couplers may comprise also waveguide portions assembled together along the E-plane. In slot couplers the waveguide portions are electromagnetically coupled between each other by means of slots, i.e. apertures provided on a thin broad wall common to both waveguide portions.

A known example of such directional slot coupler is described in H. Xin, S. Li, Y. Wang, "A terahertz-band E-plane Waveguide Directional Coupler with Broad Bandwidth", $16^{th}$ International Conference on Electronic Packaging Technology, 2015, pages 1419-1421, to which we will refer briefly as to H. Xin. H. Xin describes an E-plane waveguide directional coupler having two rectangular waveguides placed parallel to each other sharing a common broad wall. The common broad wall has three rectangular apertures electromagnetically coupling the two rectangular waveguides. However, the coupler described in H. Xin has been designed and tested for frequencies higher than 300 GHz and the use of it at lower frequencies, for example at the C or Ka bands, would require a rather long and bulky structure. Further, since apertures of the coupler described in H. Xin have relatively small size, power handling capabilities of said known coupler may be poor. A consequence of the poor power handling capability is that the known coupler may comprise secondary electron emissions in resonance with an alternating electric field leading to an exponential electron multiplication, known in the art as the so-called multipactor effect, possibly damaging the known coupler. The same effect may be found in known branch line couplers where the branches have also typically small dimensions.

Last but not least, since coupling apertures in known slot couplers as described in H. Xin are distributed widely along a cross section perpendicular to the E-plane inside the two milled half bodies with constrained or even no access from the common joining wall, manufacturing of such known couplers with conventional milling techniques and assembly method described above may be cumbersome. For this reason, branch line waveguide couplers are usually preferred for space applications, but due to the length of the branches, they occupy more volume than an equivalent slot coupler resulting in bulkier RF networks.

SUMMARY OF THE INVENTION

It would be advantageous to have an improved E-plane waveguide directional coupler.

The invention is defined by the independent claims; the dependent claims define advantageous embodiments.

A directional coupler for coupling an electromagnetic signal from an open end of the directional coupler to a plurality of open ends of the directional coupler is provided. The directional coupler comprises:

- two hollow bodies forming two waveguide portions, each hollow body having an open end arranged at a first side of the hollow body and another open end arranged at a second side of the hollow body opposite to the first side in a longitudinal direction of the hollow body, the hollow body having a first cross section perpendicular to the longitudinal direction, a second cross section along the longitudinal direction for defining a first plane of propagation of the electric field. The two waveguide portions have a common wall along the longitudinal direction forming a septum between the two waveguide portions on a second plane orthogonal to the first plane. The septum has an aperture for coupling the two waveguide portions and the aperture has a shape comprising a slanted part with respect to the longitudinal direction.

In hollow bodies forming waveguide portions, the electromagnetic signal is carried by a so-called fundamental mode, e.g. the $TE_{10}$ mode in waveguide portions with rectangular first cross section. By providing the aperture with a part of the shape slanted with respect to the longitudinal direction, said fundamental mode of propagation can excite an orthogonal mode of propagation, e.g. the $TE_{01}$ mode in waveguide portions with square first cross section, coupling part of the power of the fundamental mode to the orthogonal mode. Over the operating frequency band, this orthogonal mode cannot propagate at the open ends of the hollow waveguide portions and is said to be below cut-off frequency. This orthogonal mode excited by the aperture couples back along the longitudinal direction to the fundamental modes propagating in the opposite side of the hollow bodies and leads to a desired coupling between the plurality of open ends.

For example, in an embodiment the slanted part of the aperture has a staircase, saw tooth, spline or polynomial shape. It has been found that smooth shapes such as that of high order polynomials, for example Legendre polynomial functions, may increase an operating frequency bandwidth of the directional coupler, i.e. the directional coupler is more broadband.

In an embodiment, the shape of the aperture is reflection asymmetric with respect to the first plane. Any shape of the aperture which is reflection asymmetric with respect to the E-plane is a shape suitable for exciting the orthogonal mode of propagation, e.g. the $TE_{01}$ mode in waveguide portions with square or almost square first cross section. For example, irregular shapes such as irregular polygons, or even regular polygons with a side slanted with respect to the longitudinal direction not having an axis of symmetry at an intersection of the E-plane with a plane of the septum, may be applied.

In an embodiment, the aperture has a shape which is neither rectangular nor square.

In an embodiment, the septum is provided with a single aperture. Compared to known slot couplers operating at a specific frequency, a single aperture may be larger than multiple apertures of smaller dimensions. This has been found advantageous to increase coupling at the specific operating frequency. Further, since power handling capabilities of the directional coupler are also limited by the dimension of the aperture, providing a single larger aperture increases power handling capabilities compared to known slot couplers having multiple smaller apertures.

In an embodiment, the waveguide portions are configured to each have a rectangular or semi-circular or semi-elliptical first cross section and a rectangular second cross section. For example, the directional coupler may have the form of a rectangular prism or cuboid or cylinder or elliptic cylinder.

Another aspect of the invention provides a method of manufacturing a directional coupler. The method comprises providing two half solid bodies made of a selected material, removing the material from each half body for leaving one or more walls protruding from a cavity produced by the removed material. The walls are aligned along a longitudinal direction of each half body. The cavity extends from a first side of the half body to a second side of the half body opposite to the first side in the longitudinal direction. The cavity has an open side along the longitudinal direction of the half body. The two half bodies have equal cross sections perpendicular to said longitudinal direction.

after removing the material, assembling the two half bodies on top of each other along the open side such that the one or more walls of one half body are joining with the one or more walls of the other half body, each on a single plane.

At least one of more walls has a side edge having a slanted part with respect to the longitudinal direction.

For example, removing the material may be done with milling technologies. Since the two half bodies are assembled along the first plane of propagation of the electric field, i.e. the E-plane, impact of manufacturing and assembly imperfections on the performance of the directional coupler is reduced.

BRIEF DESCRIPTION OF THE DRAWINGS

Further details, aspects and embodiments of the invention will be described, by way of example only, with reference to the drawings. Elements in the figures are illustrated for simplicity and clarity and have not necessarily been drawn to scale. In the Figures, elements which correspond to elements already described may have the same reference numerals. In the drawings, FIG. 1*a* schematically shows a perspective view of an embodiment of a directional coupler, FIG. 1*b* schematically shows another perspective view of the embodiment of FIG. 1*a*, FIG. 2*a* schematically shows an embodiment of a septum, FIG. 2*b* schematically shows an embodiment of a septum, FIG. 2*c* schematically shows an embodiment of a septum, FIG. 2*d* schematically shows an embodiment of a septum, FIG. 3*a* schematically shows an embodiment of a directional coupler split in two halves, FIG. 3*b* schematically shows a graph representation of modes of propagation in an embodiment of a septum polarizer, FIG. 4*a* schematically shows a graphical representation of the electric field strength in a plane of propagation of the electric field for an embodiment of a directional coupler, FIG. 4*b* schematically shows a graph representation of the scattering parameters versus frequency simulated for an embodiment of a directional coupler, FIG. 4*c* schematically shows a graph representation of the scattering parameters versus frequency simulated for an embodiment of a directional coupler, FIG. 4*d* schematically shows a graph representation of the scattering parameters versus frequency simulated for an embodiment of a directional coupler, FIG. 5*a* schematically shows a perspective view of an embodiment of a 6-port directional coupler, FIG. 5*b* schematically shows a graph representation of the scattering parameters versus frequency simulated for an embodiment of a 6-port directional coupler, FIG. 5*c* schematically shows a graphical representation of the electric field in a plane of propagation of the electric field for an embodiment of a 6-port directional coupler, FIG. 6 schematically shows a perspective view of an embodiment of a N-port directional coupler, FIG. 7 schematically shows a flow diagram of a method of manufacturing a directional coupler, FIG. 8*a* schematically shows a half body processed with an embodiment of a method of manufacturing a directional coupler, FIG. 8*b* schematically shows a half body processed with an embodiment of a method of manufacturing a directional coupler.

LIST OF REFERENCE NUMERALS FOR FIGS. 1*a*, 1*b*, 2*a*, 2*b*, 2*c*, 2*d*, 5*a*, 6, 8*a* and 8*b*

1-4 an open end

10, 20 a side

Figure 1A:
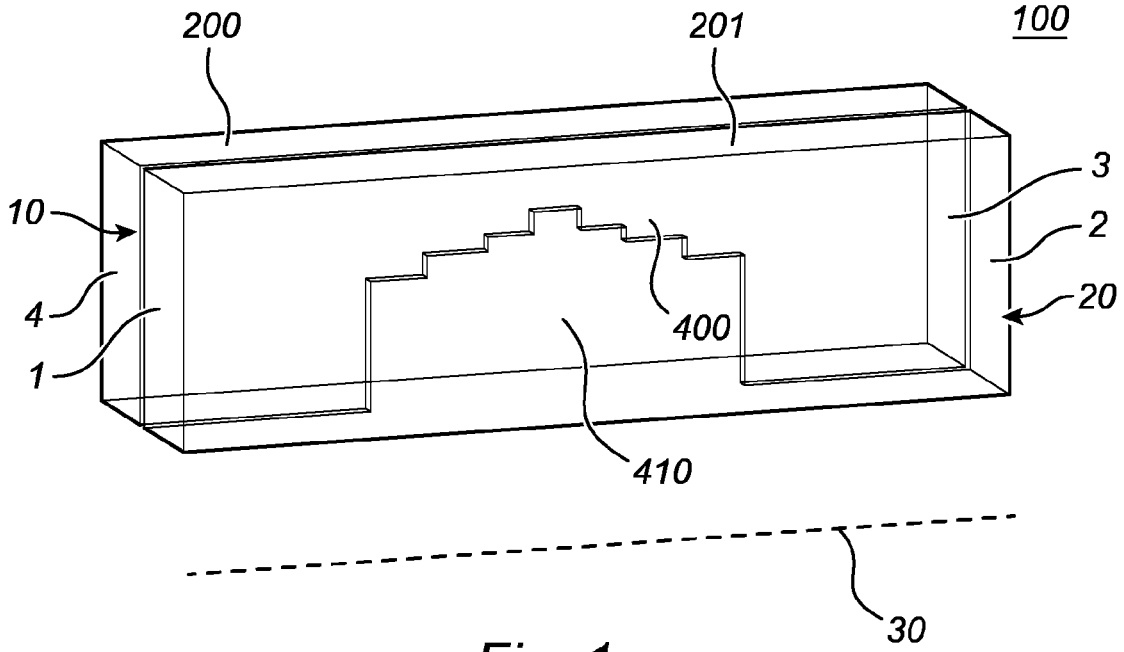

30 a longitudinal direction
50 an E-plane
100-102 a directional coupler
200-202 a hollow body
400-403 a septum
410-414 an aperture
420-422 a first part of a shape
430-432 a second part of a shape
800-801 a processed solid half body

DETAILED DESCRIPTION OF PREFERRED EMBODIMENTS

While this invention is susceptible of embodiment in many different forms, there are shown in the drawings and will herein be described in detail one or more specific embodiments, with the understanding that the present disclosure is to be considered as exemplary of the principles of the invention and not intended to limit the invention to the specific embodiments shown and described.

In the following, for the sake of understanding, elements of embodiments are described in operation. However, it will be apparent that the respective elements are arranged to perform the functions being described as performed by them.

FIG. 1*a* schematically shows a perspective view of an embodiment of a directional coupler 100.

Figure 1B:
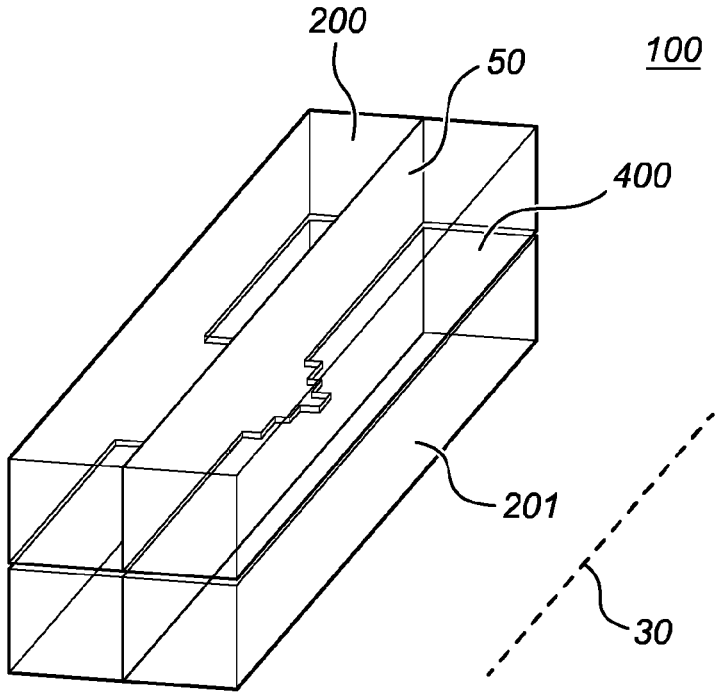

FIG. 1*b* shows another perspective view of the same embodiment of the directional coupler 100 shown in FIG. 1*a*.

Directional coupler 100 couples an electromagnetic signal from an open end of the directional coupler 100 to a plurality of open ends of directional coupler 100, e.g. from open end 1 to open ends 2 and 3 while maintaining open end 4 isolated.

Directional coupler 100 comprises two hollow bodies forming two waveguide portions 200 and 201. The electromagnetic signal propagates through the hollow bodies which are, as described below, surrounded by conductive material, e.g. aluminum, except at the open ends 1, 2, 3 and 4.

Each waveguide portion 200 and 201 has an open end arranged at a first side 10 of the waveguide portion and another open end arranged at a second side 20 of the waveguide portion opposite to the first side along a longitudinal direction 30 of the waveguide portion.

Waveguide portions 200 and 201 have a first cross section perpendicular to longitudinal direction 30. With reference to FIG. 1*b*, a second cross section along longitudinal direction 30 defines a plane 50 on which the electric field propagates. Plane 50 is the so called E-plane for directional coupler 100.

Waveguide portions 200 and 201 have a common wall along the longitudinal direction forming a septum 400 on a second plane orthogonal to the E-plane between the two waveguide portions 200 and 201. The septum has an aperture 410 for coupling waveguide portions 200 and 201. Aperture 410 provides physical coupling between waveguide portions 200 and 201. In operation, for example in a RF network or beam forming network, aperture 410 provides an electromagnetic coupling between waveguide portions 200 and 201. Aperture 410 has a shape comprising at least a part which is slanted with respect to longitudinal direction 30. In other words, the aperture is defined by its edge which is also the edge of the septum along the aperture. The edge of the aperture defines the shape of the aperture. Herein in this document the word slanted means that the shape of the aperture may comprise one or more parts which have a slope relative to the longitudinal direction. However, as it will be apparent from several embodiments described below, said one or more parts may comprise sub-parts which may or may not be slanted with respect to the longitudinal direction.

Directional coupler 100 may be used in any suitable space or ground applications.

In an embodiment, directional coupler 100 may be one component of a radio frequency (RF) waveguide network. The RF waveguide network may include one or more directional couplers of the type described above. The RF waveguide network may, for example, feed an antenna for transmitting an electromagnetic signal from a source to the antenna. The RF waveguide network may, for example, feed a receiver for transmitting an electromagnetic signal from an antenna to the receiver. Directional coupler 100 may provide transmission of the electromagnetic signal in a desired direction with desired coupling factor in any section of the RF waveguide network.

Directional coupler 100 is a four-port coupler. With reference to FIG. 1*a*, directional coupler 100 comprises an open end 1 of waveguide portion 201 and an open end 4 of waveguide portion 200 arranged at first side 10 and an open end 2 of waveguide portion 201 and an open end 3 of waveguide portion 200 arranged at second side 20. In the example, directional coupler 100 is symmetric: any of open ends 1 to 4 may be used as input port for inputting the electromagnetic signal which then propagates to the open ends at the opposite side while maintaining the other open end at the same side isolated.

In an embodiment, open end 1 may be used as input port configured to receive an input electromagnetic signal, open end 2 may be used as through port configured to output a first electromagnetic signal coupled to the input electromagnetic signal, open end 3 may be used as coupling port configured to output a second electromagnetic signal coupled to the input electromagnetic signal, and open end 4 may be used as isolated port. Directional coupler 100 thus couples the electromagnetic signal from input port 1 to through port 2 and coupling port 3. The term directional means that directional coupler 100 works in only one direction: if the input electromagnetic signal is inputted to input port 1, then there is no coupling between input port 1 and isolated port 4.

In an embodiment further described later, the shape of the aperture is arranged to induce an absolute phase difference between the first electromagnetic signal and second electromagnetic signal of substantially 90 degrees.

In an embodiment shown later, the first electromagnetic signal has a first electromagnetic signal power and the second electromagnetic signal has a second electromagnetic signal power. The shape of the aperture may be arranged for obtaining a predetermined power ratio of the second electromagnetic signal power to the first electromagnetic signal power.

In an embodiment, the shape of the aperture is arranged for obtaining a predetermined power ratio substantially equal to one. The latter embodiment is that of a so-called hybrid or 3 dB coupler where both outputs provide electromagnetic signals with balanced amplitude, corresponding to substantially half the input electromagnetic signal power.

Waveguide portions 200 and 201 may be made of any material suitable for the specific implementation. For example, waveguide portions 200 and 201 may have walls made of an electrical conductor material, for example metal. Waveguide portions 200 and 201 may be filled with a homogeneous, isotropic material supporting the propagation of electromagnetic signals, for example air.

In the embodiment shown in FIG. 1*a* and FIG. 1*b*, waveguide portions 200 and 201 have a rectangular cross section perpendicular to longitudinal direction 30 and a rectangular cross section along longitudinal direction 30, i.e. along the E-plane. In other words, waveguide portions 200 and 201 are rectangular waveguides, i.e. having the shape of a rectangular prism or cuboid, arranged on top of each other with a common rectangular waveguide broad wall.

In an embodiment not shown in the Figures, the waveguide portions may have a square cross section perpendicular to longitudinal direction 30 and a rectangular cross section along longitudinal direction 30, i.e. along the E-plane.

In an embodiment not shown in the Figures, the waveguide portions may have a semi-circular cross section perpendicular to longitudinal direction 30 and a rectangular cross section along longitudinal direction 30, i.e. along the E-plane. In the latter embodiment, the waveguide portions may be semi-cylindrical. The coupler may be in this case a circular waveguide with a septum arranged along a diameter of the circular waveguide, i.e. having the shape of a cylinder.

In the embodiment shown in FIG. 1*a* and FIG. 1*b*, each waveguide portion 200 and 201 has a constant cross section perpendicular to longitudinal direction 30.

In an embodiment, each waveguide portion may have a cross section perpendicular to the longitudinal direction varying along the longitudinal direction. Said varying cross section may provide waveguide impedance matching and thus enhance RF performance.

In an embodiment, the cross section may have a first cross section shape for a first portion of the direction coupler along the longitudinal direction and having a second cross section shape in a second portion of the directional coupler along the longitudinal direction. The second cross section shape may be identical to the first cross section shape. The first cross section may have a first area and the second cross section may have a second area different from the first area.

In an embodiment, the second cross section shape may be different from the first cross section shape.

The first cross section shape and the second cross section shape may be any of rectangular, square, semi-circular or semi-elliptical shape.

In an embodiment each waveguide portion 200 and 201 is a rectangular waveguide having rectangular first walls and rectangular second walls. The rectangular second walls are parallel to the E-plane and narrower than the first walls. The slanted part of the septum may partially extend between the second walls, i.e. between the narrower walls. In the latter embodiment, the aperture of the septum may have a shape having parts extending in a diagonal direction with respect to the longitudinal direction not completely extending between the narrower walls. Alternatively, the slanted part of the septum may completely extend between the second walls, i.e. between the narrower walls.

The aperture of the septum may have any suitable shape comprising a part slanted with respect to the longitudinal direction.

In an embodiment, the aperture has a shape which is neither rectangular nor square.

In an embodiment, the septum has a single aperture. By providing a single aperture in a septum of a selected area, the aperture may be larger than by providing multiple apertures in the same area. Power handling capabilities of the directional coupler may thus be improved and a broader range of coupling coefficient may be covered, for example from 1 to 5 dB or outside this range. The directional coupler of the invention may be suitable to meet a broader range of specifications in the design of RF waveguide networks as compared to for example known slot couplers which are usually limited to lower coupling values.

To explain further, FIG. 2*a* to FIG. 2*d* shows various embodiments of a septum.

Figure 2A:
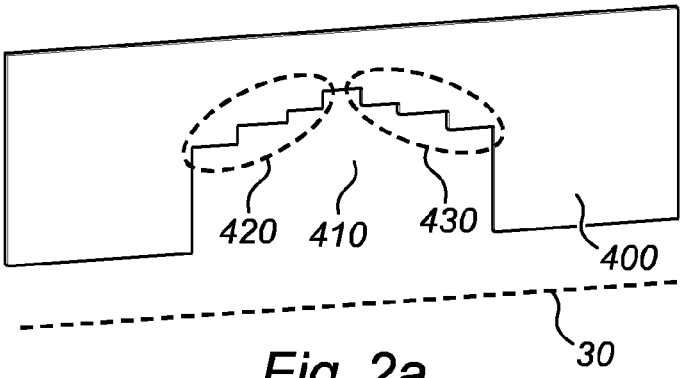

FIG. 2*a* shows an embodiment of a septum 400. Septum 400 has an aperture 410. Aperture 410 has a shape comprising a first part 420 and a second part 430. First part 420 and second part 430 are slanted with respect to longitudinal direction 30. First part 420 of aperture 410 has a first slope. Second part 430 has a second slope opposite to the first slope, i.e. with opposite sign with respect to the first slope. In this example first part 420 and second part 430 have a staircase shape. In other words, first part 420 and second part 430 comprise alternatively horizontal and vertical sub-parts, wherein the horizontal sub-parts are parallel to the longitudinal direction.

Figure 2B:
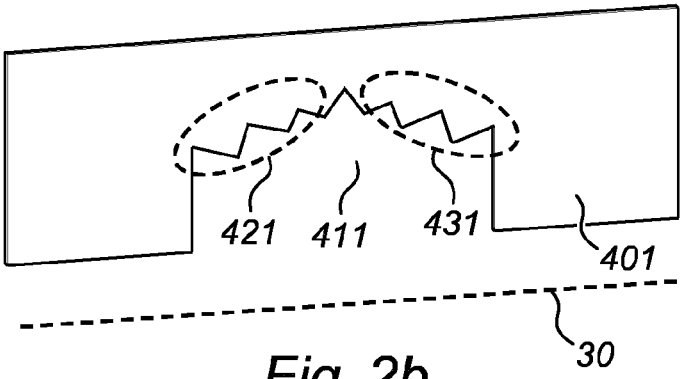

FIG. 2*b* shows an embodiment of a septum 401. Septum 401 has an aperture 411. Aperture 411 has a shape comprising a first part 421 and a second part 431. First part 421 and second part 431 are slanted with respect to longitudinal direction 30. First part 421 of aperture 411 has a first slope. Second part 431 has a second slope opposite to the first slope, i.e. with opposite sign. In this example first part 421 and second part 431 have a saw-tooth shape.

Figure 2C:
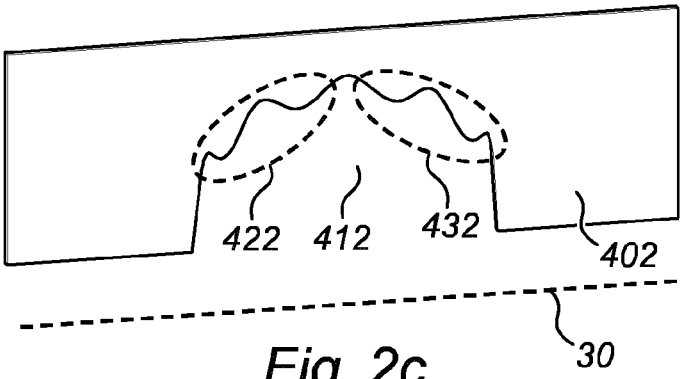

FIG. 2*c* shows an embodiment of a septum 402. Septum 402 has an aperture 412. Aperture 412 has a shape comprising a first part 422 and a second part 432. First part 422 and second part 432 are slanted with respect to longitudinal direction 30. First part 422 of aperture 412 has a first slope. Second part 432 has a second slope opposite to the first slope. In this example first part 422 and second part 432 have substantially a linear shape slanted with respect to longitudinal direction 30.

Figure 2D:
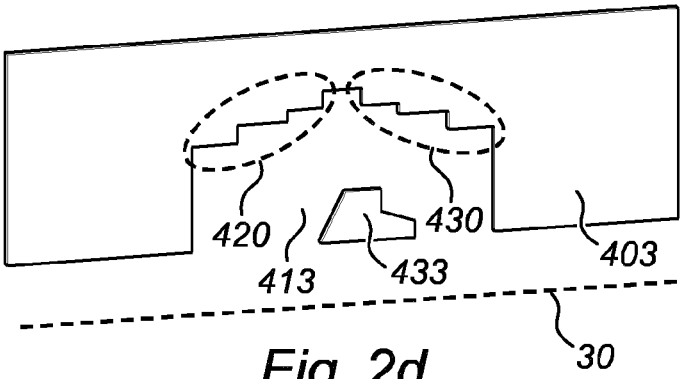

FIG. 2*d* shows an embodiment of a septum 403. Septum 403 differs from septum 400 in that it has a part 433 protruding from a narrow wall of one of the rectangular waveguide and partially extending to the opposite narrow wall towards slanted parts 420 or 430.

Other aperture profiles are possible.

In an embodiment, polynomial or spline functions may be used to shape a profile of the first part and the second part of the aperture. For example, Legendre polynomial functions or any other type of suitable polynomial or spline functions may be used. It has been found that when the septum has a profile of the aperture defined by a polynomial function, the directional coupler shows better RF performance over a broader frequency band.

In an embodiment, the aperture is reflection symmetric with respect to a plane orthogonal to the longitudinal direction cutting the directional coupler in two identical waveguide sub-portions.

In all embodiments described with reference to FIGS. 2*a*-2*d*, the aperture has a shape which is reflection asymmetric with respect to the first plane, i.e. the E-plane. Any shape of the aperture which is not reflection symmetric with respect to the E-plane is a shape suitable for exciting the electric field propagating with $TE_{01}$ mode. For example, irregular shapes such as irregular polygons, or even regular polygons not having an axis of symmetry at an intersection of the E-plane with a plane of the septum, may be applied.

In all embodiments described with reference to FIGS. 2*a*-2*d*, the aperture has a shape with at least a part partially extending in a direction perpendicular or quasi perpendicular to the longitudinal direction and another part consecutively connected to the first part which is slanted with respect to the longitudinal direction.

Waveguide portions consisting of hollow bodies as described with reference to FIGS. 1*a* and 1*b*, support only a few modes of propagation of the electromagnetic field, namely the so-called transverse electric and the so-called transverse magnetic modes, i.e. the TE and TM modes, but not the transverse electromagnetic modes, i.e. the TEM modes. In rectangular waveguide portions, rectangular mode numbers are commonly designated by two suffix numbers attached to the mode type, such as $TE_{mn}$ or $TM_{mn}$, where m is the number of half-wave patterns across a width of the rectangular waveguide and n is the number of half-wave patterns across a height of the rectangular waveguide. In circular waveguides, circular modes exist and here m is the number of full-wave patterns along the circumference and n is the number of half-wave patterns along the diameter.

The staircase shape shown in FIG. 2*a* has been found to be suitable to excite a mode of propagation of the electric field orthogonal to that applied to the input port of the coupler. The electric field applied to the input port has transverse electric 01 mode of propagation, i.e. the $TE_{10}$ mode, also known as fundamental mode because this mode, having the lowest cut-off frequency in rectangular waveguides, is the first one to propagate as frequency increases.

In other words, referring to FIG. 2*a*, waveguide portions 200 and 201 and open ends 1 to 4 are sized such that only this fundamental mode would propagate as if waveguide portions 200 and 201 were rectangular waveguides with no coupling between each other, i.e. as if no aperture was present.

The mode of propagation orthogonal to that applied to the input port of the coupler is called in the art transverse electric 01 mode, i.e. $TE_{01}$ mode.

As it will be explained later, the shape of the septum and dimension of the aperture may be used to tune a phase difference and an amplitude ratio of the electric field propagating with $TE_{01}$ mode and with $TE_{10}$ mode.

In an embodiment described below, the directional coupler may be described as two waveguide polarizers comprising a septum on a plane orthogonal to the E-plane. The two waveguide polarizers are arranged back to back at an open end of each waveguide polarizer where the septum partially extends between walls of the waveguide polarizer. The septum may be used to obtain, at half length of the directional coupler, different type of polarizations associated to different combinations of the two orthogonal electric field modes $TE_{01}$ and $TE_{10}$.

For example, polarization may be circular or elliptical depending on the differential phase induced by the septum between the two orthogonal electric field modes.

Figure 3A:
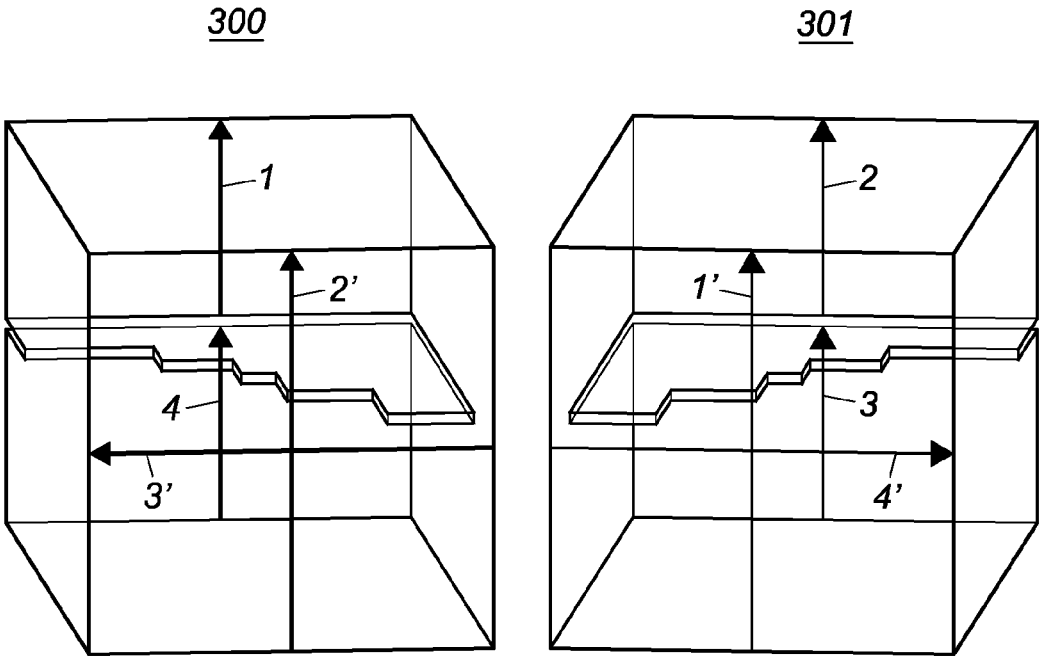

FIG. 3*a* schematically shows a cross section of an embodiment of a directional coupler along a plane dividing the directional coupler in two identical portions. Each half portion acts as a septum polarizer 300, 301. Analytical analysis for directional coupler 100 can be derived by analytical analyses of septum polarizer 300 and septum polarizer 301.

For example, with reference to septum polarizer 300, four ports 1, 2', 3' and 4 are indicated. Ports 1 and 4 may correspond to the input and isolated port of an embodiment of the directional coupler described above. Ports 2' and 3' may correspond to intermediate ports at half length of the directional coupler. These four ports 1, 2', 3' and 4 are sized to propagate the fundamental modes in hollow waveguides, being the $TE_{10}$ mode of a rectangular waveguide portion associated to ports 1 and 4, and the $TE_{10}$ and $TE_{01}$ modes of a square waveguide portion associated to ports 2' and 3', respectively. When excited at one of the two ports 1 or 4, the septum polarizer will split equally the signal towards ports 2' and 3' with a phase difference that will depend on the shape of the septum and on the port excited. Ports 1 and 4 will excite port 2' with the same insertion phase, but port 3' with opposite insertion phases.

This can be better understood by using a known technique called in the art as decomposition into even and odd modes, i.e. modes having either the same phase or opposite phase of propagation, respectively.

Figure 3B:
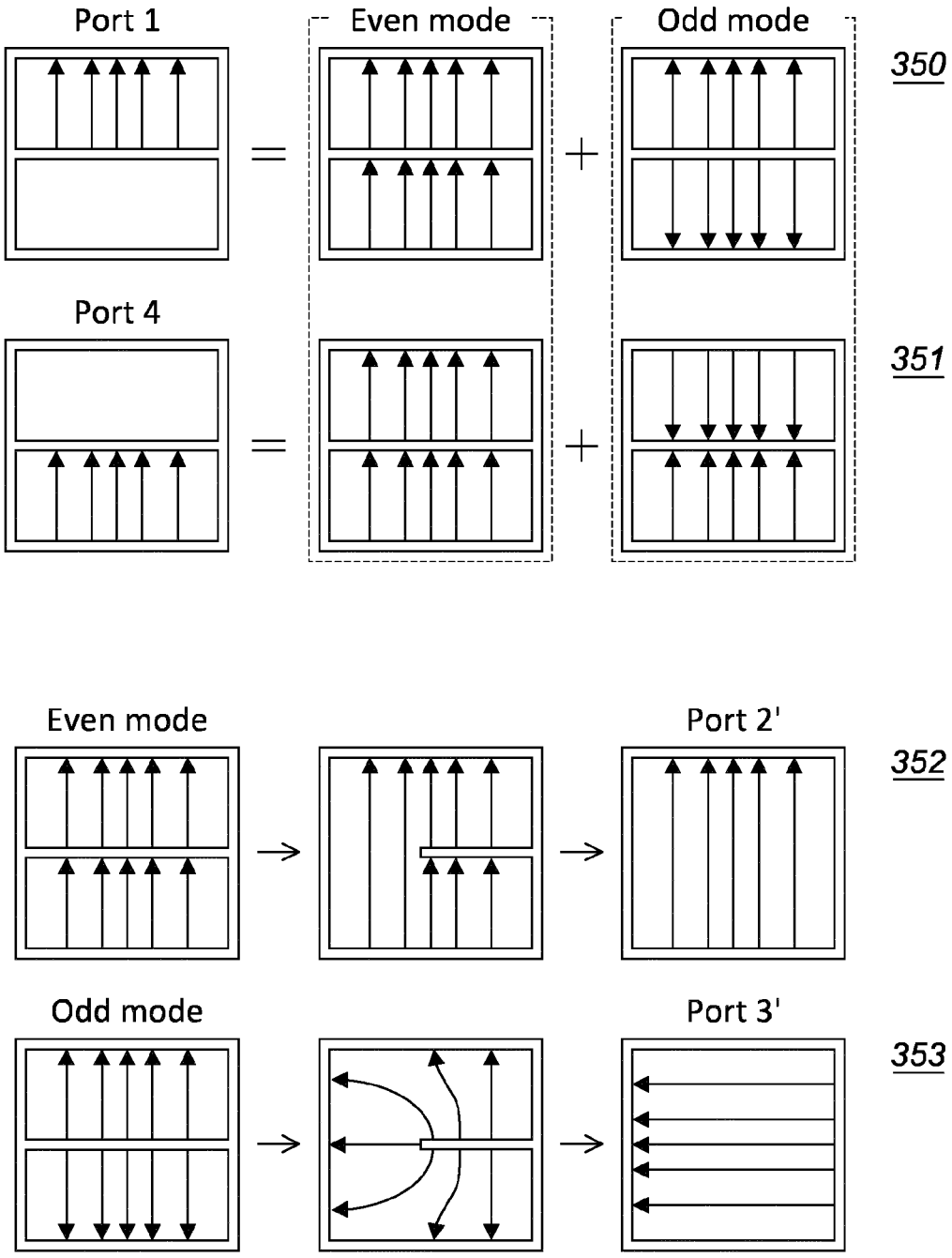

FIG. 3*b* schematically shows a graph representation of mode of propagation in an embodiment of septum polarizer 300. Graph representation 350 shows decomposition of the electromagnetic signal at port 1 into even and odd modes, respectively. Graph representation 351 shows decomposition of the electromagnetic signal at port 4 into even and odd modes, respectively. Graph representation 352 shows how the even mode of propagation changes by changing a profile of the septum along a cross section orthogonal to the longitudinal direction. Graph representation 353 shows how the odd mode of propagation changes by changing a profile of the septum along a cross section orthogonal to the longitudinal direction. Electric field vectors are drawn for each even and odd mode of propagation at different cross sections orthogonal to the longitudinal direction in a direction of propagation. Different shape of the electric field vectors between graph 352 and graph 353 indicate different phase velocity which in turns gives rise to a phase difference between the two orthogonal modes in the square cross section.

Assuming septum polarizer 300 is matched at all ports, ports 1 and 4 are isolated and ports 2' and 3' are also isolated, the scattering matrix of the septum polarizer may be written as:

$$[S] = \frac{1}{\sqrt{2}}\begin{bmatrix} 0 & 1 & e^{j\phi} & 0 \\ 1 & 0 & 0 & 1 \\ e^{j\phi} & 0 & 0 & -e^{j\phi} \\ 0 & 1 & -e^{j\phi} & 0 \end{bmatrix} \tag{1}$$

Depending on the phase difference between signals at ports 2' and 3', the septum polarizer may produce circularly polarized ($\phi=\pm 90$ degrees) or linearly polarized ($\phi=0$ or $\phi=180$ degrees) electromagnetic signal. Both circular and linear polarization are particular cases of elliptical polarization which is generated for any other value of the phase difference.

In a back-to-back septum polarizer configuration, as illustrated in FIG. 3*a*, septum polarizer 300 has its scattering matrix as defined in (1). Using symmetry considerations, the scattering matrix of septum polarizer 301 can also be found:

$$[S'] = \frac{1}{\sqrt{2}}\begin{bmatrix} 0 & 1 & 1 & 0 \\ 1 & 0 & 0 & e^{j\phi} \\ 1 & 0 & 0 & -e^{j\phi} \\ 0 & e^{j\phi} & -e^{j\phi} & 0 \end{bmatrix} \tag{2}$$

The transmission coefficients of the resulting total scattering matrix when inputting an electromagnetic signal to port 1 or 4 are obtained as follows:

$$\begin{cases} S_{21}^T = S'_{21'} \cdot S_{2'1} + S'_{24'} \cdot S_{3'1} = \frac{1}{\sqrt{2}} \cdot \frac{1}{\sqrt{2}} + \frac{e^{j\phi}}{\sqrt{2}} \cdot \frac{e^{j\phi}}{\sqrt{2}} \\ S_{31}^T = S'_{31'} \cdot S_{2'1} + S'_{34'} \cdot S_{3'1} = \frac{1}{\sqrt{2}} \cdot \frac{1}{\sqrt{2}} - \frac{e^{j\phi}}{\sqrt{2}} \cdot \frac{e^{j\phi}}{\sqrt{2}} \\ S_{24}^T = S'_{21'} \cdot S_{2'4} + S'_{24'} \cdot S_{3'4} = \frac{1}{\sqrt{2}} \cdot \frac{1}{\sqrt{2}} - \frac{e^{j\phi}}{\sqrt{2}} \cdot \frac{e^{j\phi}}{\sqrt{2}} \\ S_{34}^T = S'_{31'} \cdot S_{2'4} + S'_{34'} \cdot S_{3'4} = \frac{1}{\sqrt{2}} \cdot \frac{1}{\sqrt{2}} + \frac{e^{j\phi}}{\sqrt{2}} \cdot \frac{e^{j\phi}}{\sqrt{2}} \end{cases} \quad (3)$$

Equations (3) simplify into $$\begin{cases} S_{21}^T = \frac{e^{j2\phi} + 1}{\sqrt{2}} = e^{j\phi}\cos\phi \\ S_{31}^T = -\frac{e^{j2\phi} - 1}{\sqrt{2}} = -je^{j\phi}\sin\phi \\ S_{24}^T = -\frac{e^{j2\phi} - 1}{\sqrt{2}} = -je^{j\phi}\sin\phi \\ S_{34}^T = \frac{e^{j2\phi} + 1}{\sqrt{2}} = e^{j\phi}\cos\phi \end{cases} \quad (4)$$

Considering that the matrix is symmetric and maintains the matching and isolation properties of the elementary matrices, the resulting total scattering matrix is:

$$[S^T] = e^{j\phi}\begin{bmatrix} 0 & \cos\phi & -j\sin\phi & 0 \\ \cos\phi & 0 & 0 & -j\sin\phi \\ -j\sin\phi & 0 & 0 & \cos\phi \\ 0 & -j\sin\phi & \cos\phi & 0 \end{bmatrix} \quad (5)$$

When $\phi = \pm 45$ or $\phi = \pm 135$ degrees, the resulting scattering matrix is the matrix of a hybrid coupler, the outputs having the same amplitude and being in phase quadrature. Other values of $\phi$ will lead to unbalanced amplitudes while maintaining phase quadrature.

In an embodiment, the shape of the aperture is arranged for obtaining, in use, a phase difference between electromagnetic signals of 45 degrees plus a multiple integer of 180 degrees at half of the length of the directional coupler.

In an embodiment the phase difference is −45 degrees. For a phase difference of $\phi = -45$ degrees, scattering matrix (5) results in the following scattering matrix:

$$[S] = \frac{(1-j)}{\sqrt{2}}\begin{bmatrix} 0 & 1 & j & 0 \\ 1 & 0 & 0 & j \\ j & 0 & 0 & 1 \\ 0 & j & 1 & 0 \end{bmatrix} \quad (6)$$

Matrix (6) is the scattering parameter matrix of a hybrid or 3 dB coupler with a through port in phase delay with respect to the coupling port.

Cross section at half of the length of the coupler as shown in FIG. 3*a* is square. However, it has been found the cross section at half of the length may have a rectangular or circular or any other suitable shape as explained in one of the embodiments above. This provides an additional degree of freedom to further enhance an amplitude and phase flatness over the operating bandwidth of the inventive directional coupler.

Figure 4A:
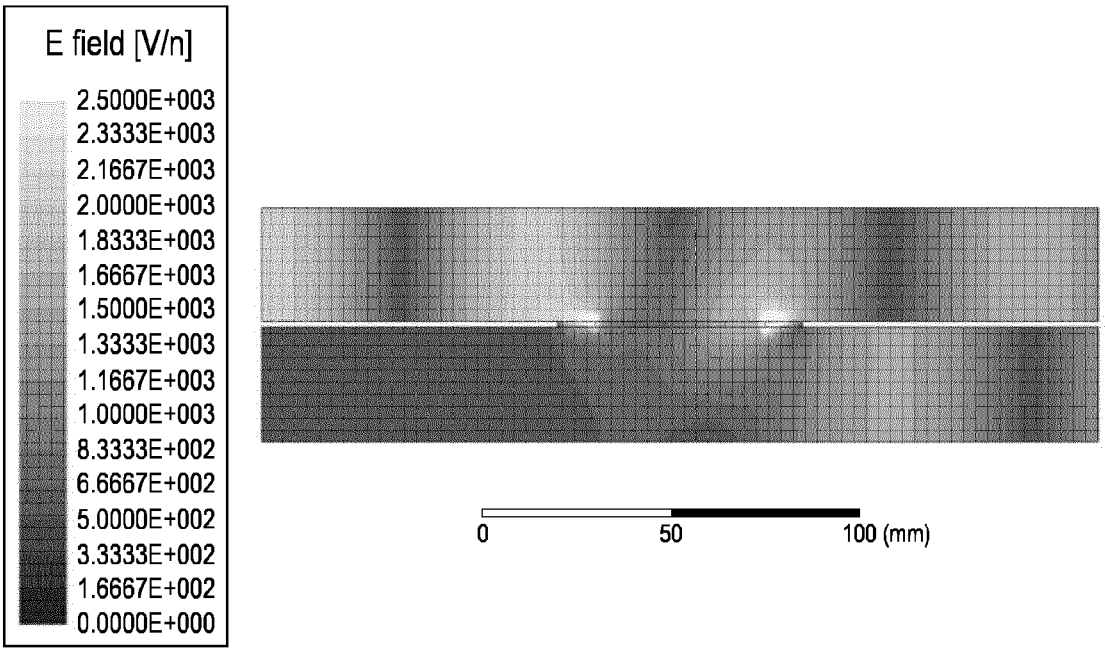

FIG. 4*a* schematically shows a graphical representation of the electric field intensity in a plane of propagation of the electric field (E-plane) for an embodiment of a directional coupler according to the invention. This graphical representation has been obtained via a three dimensional simulation (using a known software tool for this type of analysis: ANSYS HFSS) of an embodiment of a balanced directional coupler in which the coupling factor from the input port to through port and coupling port is the same. This corresponds to the special case of scattering matrix (6) reported above. The simulated directional coupler has a septum with a shape similar to that described with reference to FIG. 2*a*. In the graph of FIG. 4*a*, patterns with the same scale of grey indicate electric fields of the same intensity. Darker areas show low intensity electric fields while lighter areas show higher intensity electric fields. It can be seen that in proximity of the isolated port (left hand corner of the Figure) electric field has low intensity. It can also be seen that in proximity of the open ends at the right side of the FIG. 4*a* electric field patterns repeats cyclically with a certain phase delay, said phase delay being determined by the distance between patterns having the same scale of grey.

It can be seen that electric fields gradually increase intensity in areas of the coupler corresponding to parts of the septum slanted with respect to the longitudinal direction.

In an embodiment, power handling capabilities of the inventive directional coupler can be at least four times higher than a branch directional coupler having similar RF performance, for example having similar insertion losses, isolation and input matching performance within the same operating frequency band. It is known that when a secondary electron emission occurs in resonance with an alternating electric field, a so-called multipactor effect can be generated damaging the directional coupler. A condition for the occurrence of the multipactor effect is that a voltage threshold is reached. This voltage threshold is an indication of the power handling capability of the coupler. For non-resonant structures with low voltage magnification factors such as directional couplers, said threshold voltage is proportional to the product of the specific operating frequency and a distance between two parallel walls of the coupler. For the same operating frequency, the worst case for the threshold voltage is thus determined by the minimum distance between the two parallel walls. Since the inventive directional coupler has an aperture provided at the common wall between the two waveguide portions, the minimum distance between two parallel walls is set by a thickness of each waveguide portion. In a known branch directional coupler having similar RF performance of the inventive directional coupler, this minimum distance would be set by a distance of the walls of a branch which is typically much smaller than a thickness of a waveguide portion of the inventive coupler.

In an embodiment, a minimum distance between two parallel sections of the directional coupler is equal or larger than a thickness of a waveguide portion measured along the plane of propagation of the electric field, i.e. the E-plane. This ensures the minimum threshold voltage is set by the thickness of a waveguide portion. For example, the septum of FIG. 2*a* may be designed such that a minimum distance between two parallel sections (blades) is larger than the thickness of a waveguide portion. For example, the septum may be designed such not to have parallel sections (blades) like in the example of FIG. 2*c*. In the latter example, power handling capabilities of the directional coupler are limited.

Figure 4B:
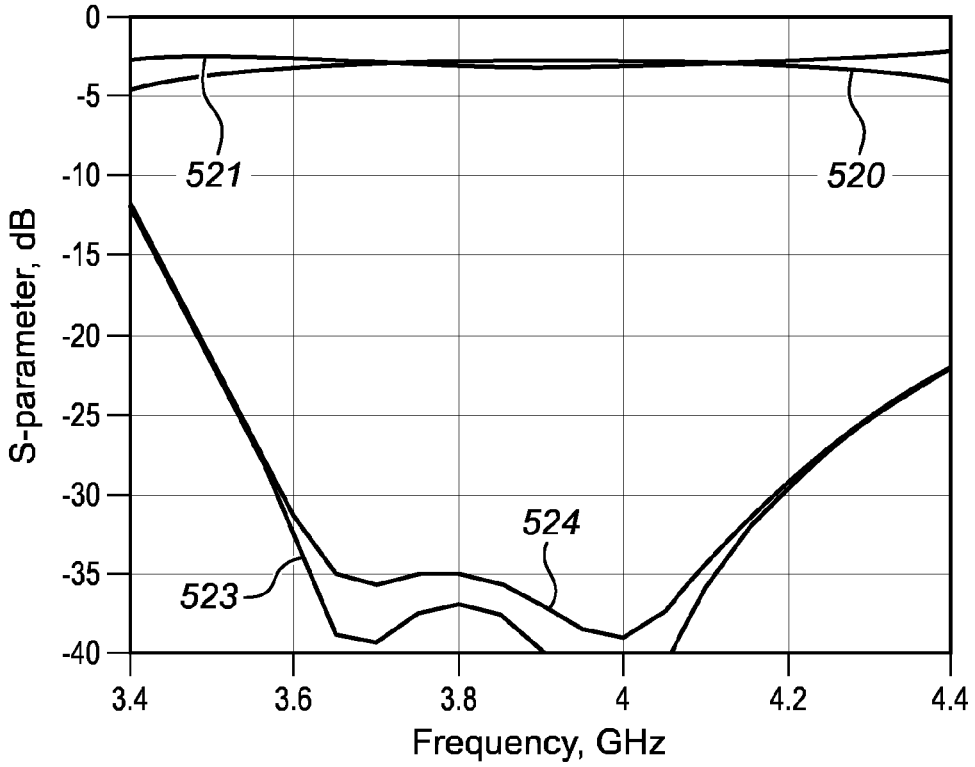

FIG. 4*b* schematically shows a graph representation of the scattering parameters versus frequency for the same embodiment of directional coupler whose electric field patterns haven been shown in FIG. 4*a*. As said, in this embodiment, the shape and dimensions of the aperture are arranged such that the directional coupler has a coupling factor of 3 dB. Like in FIG. 4*a* the scattering parameters of FIG. 4*b* are simulated with a three-dimensional simulator. The electromagnetic signals coupled at the through port and coupling port have substantially equal amplitude. Curve 520 represents the transmission coefficient between the input port and the through port of the coupler, i.e. the amplitude in Decibel of the Scattering parameter $S_{21}$. Curve 521 represents the transmission coefficient between the input port and the coupling port of the coupler, i.e. amplitude of the scattering parameter $S_{31}$. Curves 523 and 524 represent the reflection coefficients at the input port, i.e. amplitude of the scattering parameter $S_{11}$ and isolation between input port and isolated port, i.e. amplitude of the scattering parameter $S_{41}$, respectively.

Figure 4C:
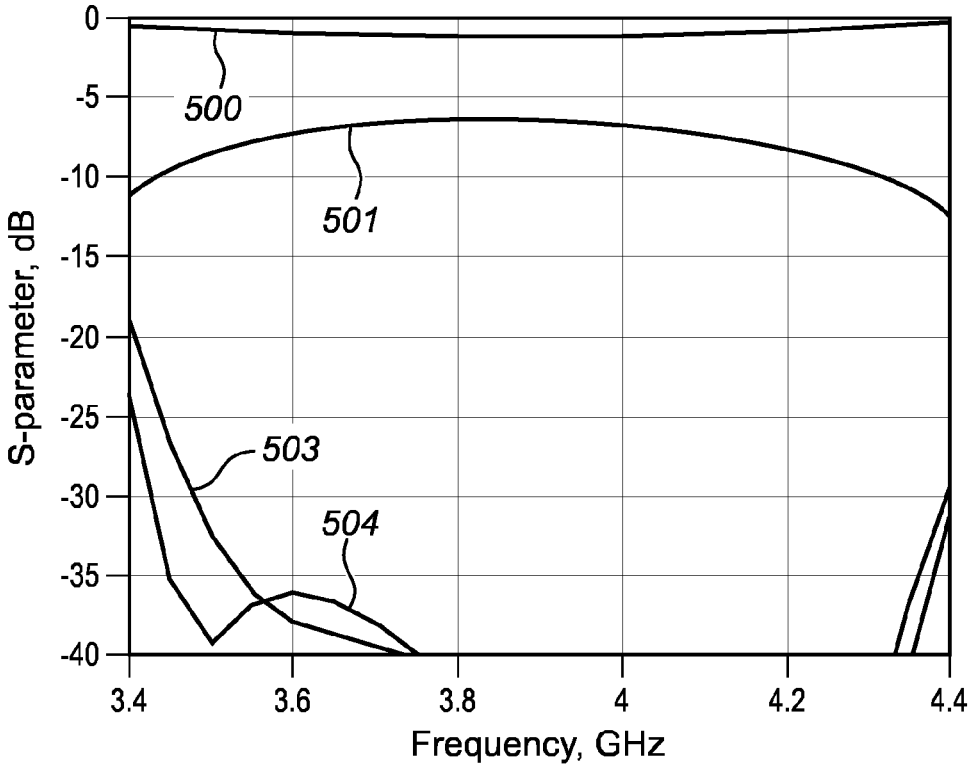

FIG. 4*c* schematically shows a graph representation of the scattering parameters versus frequency for an embodiment of a directional coupler. The directional coupler resulting with the scattering parameters shown in FIG. 4*c*, has a relatively low coupling factor, substantially equal to 5 dB. Curve 500 represents the transmission coefficient between the input port and the through port of the coupler, i.e. amplitude in Decibel of the Scattering parameter $S_{21}$. Curve 501 represents the transmission coefficient between the input port and the coupling port of the coupler, i.e. amplitude of the scattering parameter $S_{31}$. Curves 503 and 504 represent the reflection coefficients at the input port, i.e. amplitude of the scattering parameter $S_{11}$ and isolation between input port and isolated port, i.e. amplitude of the scattering parameter $S_{41}$, respectively.

Figure 4D:
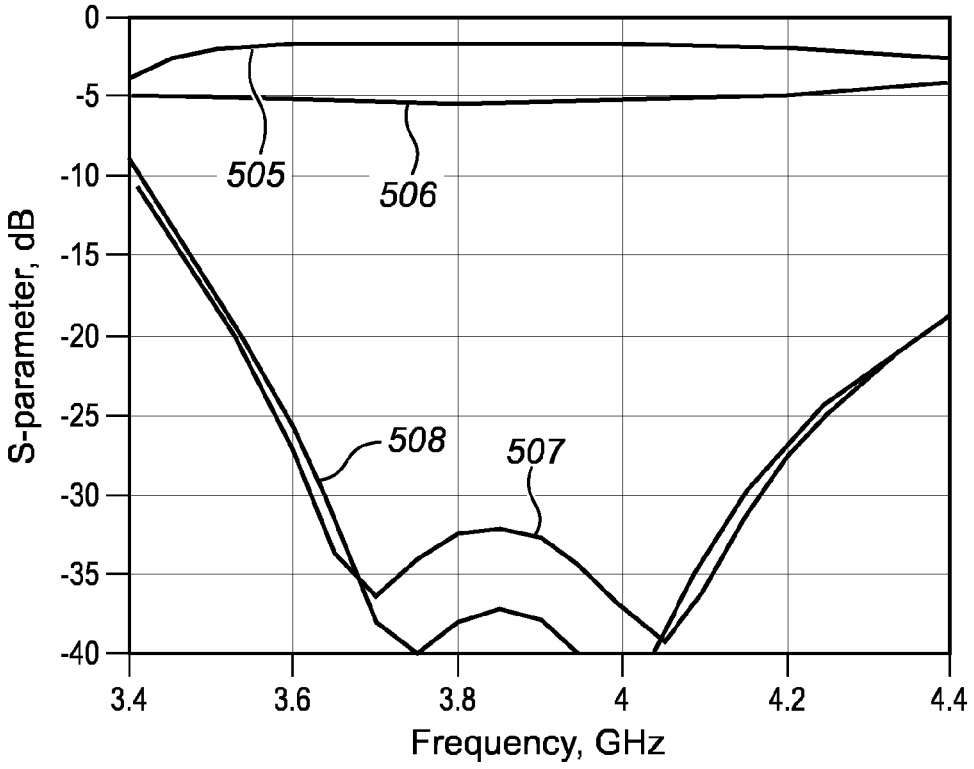

FIG. 4*d* schematically shows a graph representation of the scattering parameters versus frequency for another embodiment of a directional coupler. The directional coupler resulting with the scattering parameters shown in FIG. 4*d*, has higher coupling factor than the directional coupler simulated in FIG. 4*b* and FIG. 4*c*. The coupling factor of the directional coupler simulated in the example of FIG. 4*d* is, substantially equal to 1 dB. Curves 505-508 correspond to the same curves of FIG. 4*b* and FIG. 4*c*.

FIG. 4*b*, FIG. 4*c* and FIG. 4*d* show exemplary performance of embodiments of the inventive directional coupler. However, other coupling factors may be obtained by for example changing the shape and dimensions of the aperture.

Figure 5A:
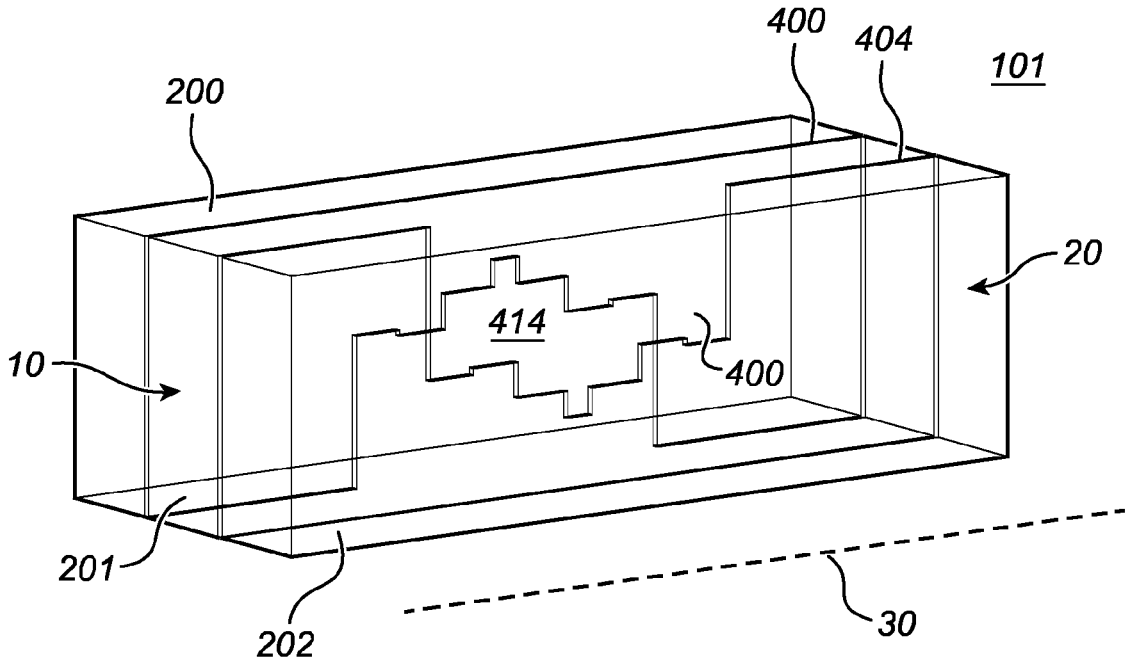

FIG. 5*a* schematically shows a perspective view of an embodiment of a directional coupler 101. Directional coupler 101 differs from directional coupler 100 shown in FIG. 1*a* in that directional coupler 101 further comprises at least a further hollow body 202 forming a further waveguide portion. Waveguide portion 201 and the further waveguide portion 202 have a further common wall along longitudinal direction 30 forming a further septum 404 between said waveguide portion 201 and the further waveguide portion 202 on the second plane.

The further septum 404 has a further aperture 414 for coupling the further waveguide portion 202 to said waveguide portion 201. The further aperture 414 has a further shape comprising a further part slanted with respect to longitudinal direction 30.

In an embodiment, as shown in FIG. 5*a*, the further shape of the further aperture 414 is identical to the shape of said first mentioned aperture 410. For example, the shape may be any of a staircase, saw tooth, spline or polynomial functions shape.

In an embodiment, as shown in FIG. 5*a*, further septum 404 is rotated on the second plane of 180 degrees with respect to the septum 400. In other words, further septum 404 is arranged on a plane parallel to the second plane and in anti-parallel with septum 400.

In an embodiment, not shown in the Figures, the further septum may be arranged in parallel with the septum such that identical aperture and further aperture overlap each other.

In an embodiment, not shown in the Figures, shapes of apertures 410 and 414 may be different.

Directional coupler 101 may for example be used as a six-port directional coupler. In beam forming network applications use of six-port directional couplers instead of four-port directional couplers may be considered in order to reduce overall volume of the network and the number of components.

As explained above also for a six-port directional coupler, shape of the apertures may be configured for adapting the coupling factor, e.g. providing balanced or unbalanced output between the three output ports.

Figure 5B:
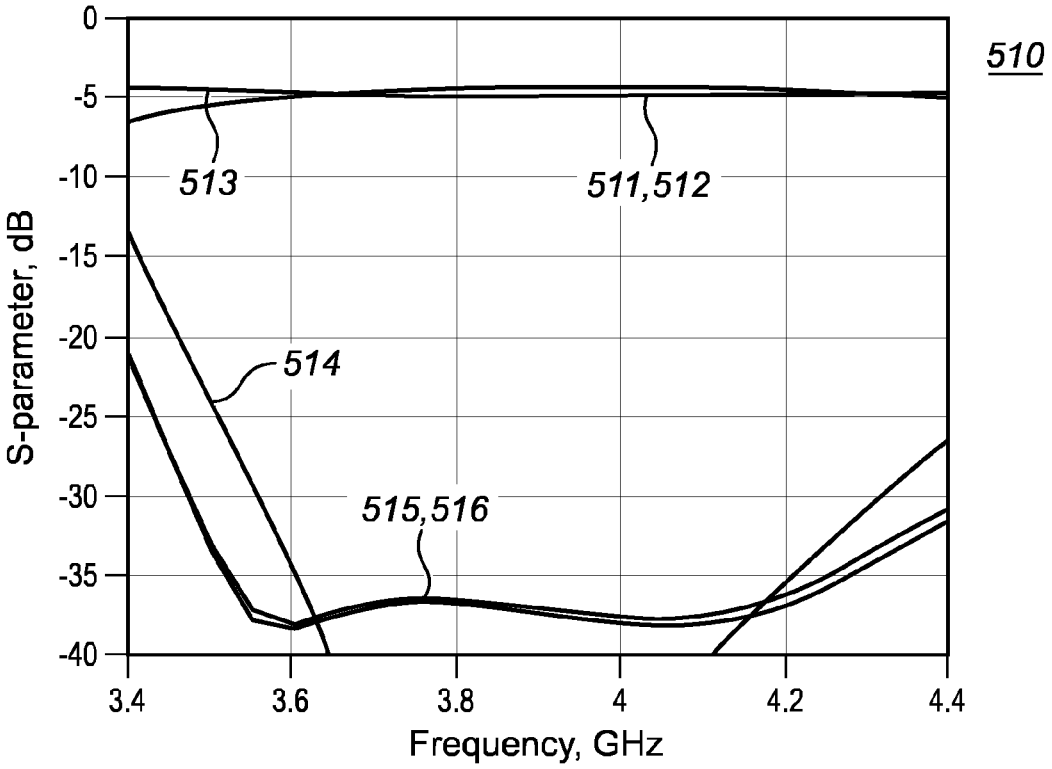

For example, FIG. 5*b* schematically shows a graph representation 510 of the scattering parameters versus frequency for directional coupler 101 where the shapes of apertures 410 and 414 and the antiparallel arrangement of the septums 400 and 404 have been chosen to obtain a balanced output between the three output ports, i.e. a coupling factor toward the three output ports of approximatively 4.77 dB. Curves 511 and 512 represent the transmission coefficients between input port and a first coupling port and a second coupling port, respectively of directional coupler 101. The First and second coupling ports are separated by a middle through port. Curve 513 represents the transmission coefficient between the input port and the through port. Further, curve 514 represents the reflection coefficient at the middle input port and curves 554 and 516 isolation between the middle input port and a first isolated port and a second isolated port. The first isolated port is separated from the second isolated port by the input port arranged at the center of directional coupler 101.

Graph 510 shows relatively flat and wide band response within the C-band down-link frequency.

In an embodiment, the shape of apertures 410 and 414 may be adapted to obtain a fractional bandwidth, i.e. the frequency bandwidth of the coupler divided by the center frequency, of more than 10%. In some embodiments the fractional bandwidth may be for example 15%, 20% or more than 20%, for example 25%. In the example shown in FIG. 5*b*, directional coupler 101 is configured to have a length and a thickness of septums 400 and 404 such that directional coupler 101 can operate at C band down-link. However, by properly scaling said dimensions of the coupler, the coupler may be configured to operate at other operating frequency bands than the C band down-link, for example at the C band uplink or Ka band downlink or Ka band uplink. Performance at different frequency bands than the C band downlink may be similar to that obtained at the C band downlink in terms of fractional bandwidth.

Figure 5C:
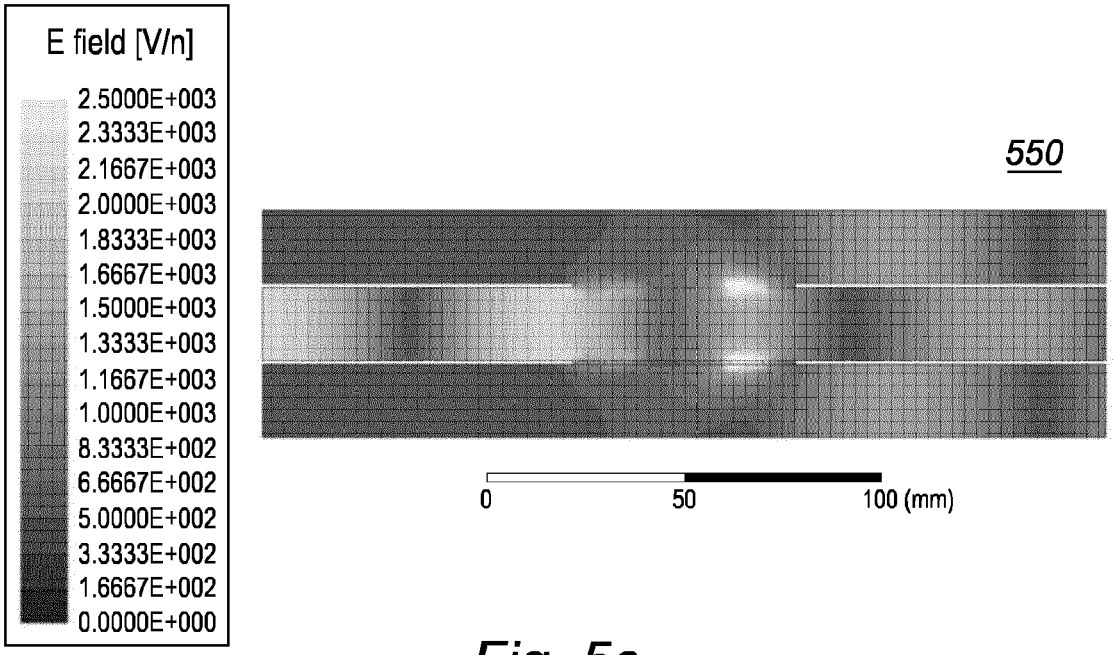

FIG. 5*c* schematically shows a graphical representation 550 of the electric field intensity in a plane of propagation of the electric field (E-plane) for directional coupler 101 with balanced outputs. Like in FIG. 4*a*, in graph 550 patterns with the same scale of grey indicate electric fields of the same intensity. Darker areas show low intensity electric fields while lighter areas show higher intensity electric fields. It can be seen that in proximity of the isolated ports (top and bottom edge ports at left hand of the Figure) electric field has low intensity. It can also be seen that in proximity of the open ends at the edges at the right side of the FIG. 4*a*, electric field patterns repeats cyclically with the same phase. Phase of the electromagnetic signal at the middle open end at the right side of the Figure is delayed by 120 degrees with respect to coupled electromagnetic signals at the coupled open ends at the edge of the coupler.

The inventive directional coupler may have more than six open ends, i.e. ports, and a number of ports may be extended to any natural number suitable for the specific application.

Figure 6:
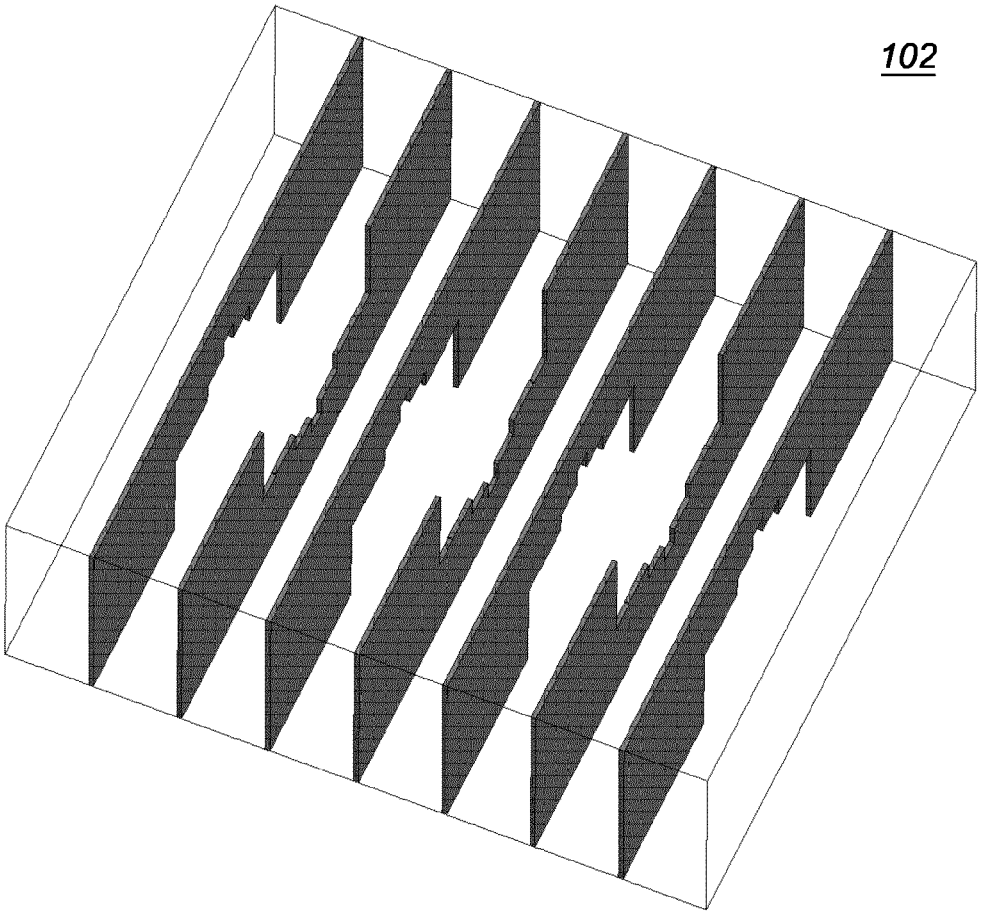

For example, FIG. 6 schematically shows a perspective view of an embodiment of a directional coupler 102. Directional coupler 102 comprises eight waveguide portions stacked along the E-plane and separated each by a septum as described in previous directional couplers.

Directional coupler 102 has thus 16 open ends, 8 on each opposite side along the longitudinal direction. Directional coupler 102 may be used in complex waveguide RF networks where many electromagnetic signals may be routed at the same time.

Figure 7:
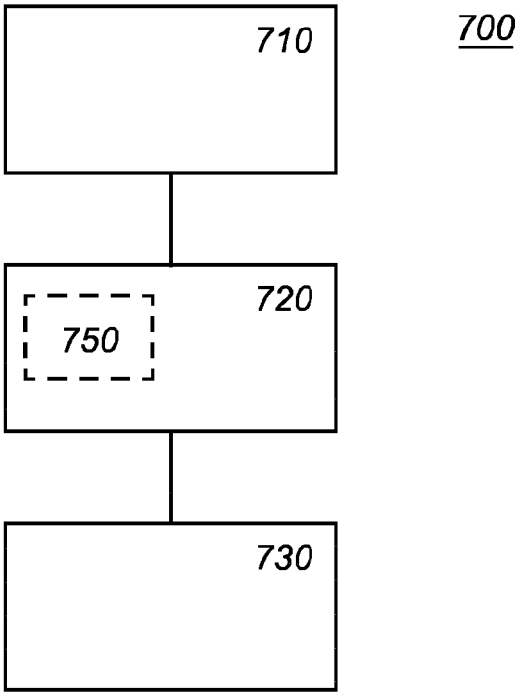

FIG. 7 schematically shows a flow diagram of a method 700 of manufacturing a directional coupler according to an embodiment of the invention.

The method 700 comprises providing 710 two half solid bodies made of a selected material, removing 720 the material from each half solid body for leaving one or more walls protruding from a cavity produced by the removed material. The walls are aligned along a longitudinal direction of each half body. The cavity extends from a first side of the half body to a second side of the half body opposite to the first side in the longitudinal direction. The cavity has an open side along the longitudinal direction of each half body. The two half solid bodies have equal cross sections perpendicular to said longitudinal direction.

After removing 720 the material, assembling 730 the two half bodies along the open side such that the one or more walls of one half body are joining the one or more walls of the other half body on a single plane for forming two waveguide portions having a common wall between the two waveguide portions on a plane orthogonal to the single plane.

The common wall results from joining one or more walls of one half body with the one or more walls of the other half body.

At least one of the wall has a side edge having a part slanted with respect to the longitudinal direction for forming an aperture in the common wall, the aperture coupling the two waveguide portions and having a shape comprising a slanted part with respect to the longitudinal direction. In other words, the common wall forms a septum between the two waveguide portions on a plane orthogonal to the single plane. The septum has an aperture formed by joining one or more walls of the half bodies, wherein at least one wall has a side edge with a slanted part. Thereby the aperture has a shape comprising a slanted part with respect to the longitudinal direction.

Removing 720 the material may be done with any suitable technology. For example, removing 720 may comprise milling technologies.

Conventional printed waveguide technologies like Substrate Integrated Waveguide (SIW) technologies may also be used.

In an alternative method, recent manufacturing technics including for example additive manufacturing may also be considered. In such alternative method the coupler may be directly manufactured by consecutively adding layers of a suitable material over each other, like for example it is done in three-dimensional printing technologies.

Figure 8A:
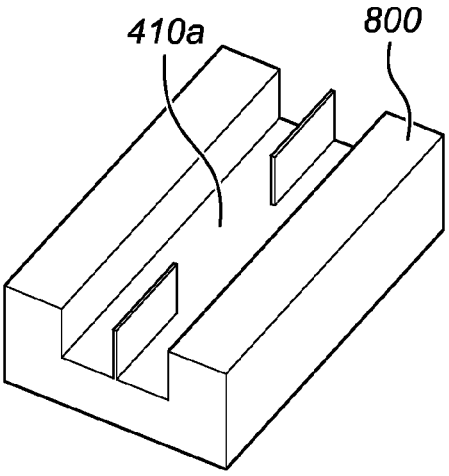
Figure 8B:
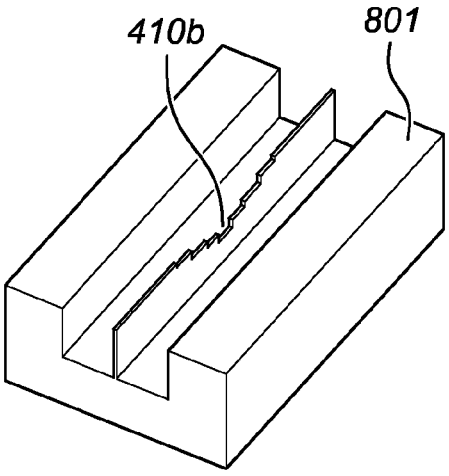

FIG. 8*a* and FIG. 8*b* schematically show a processed half body 800 and a half body 801 processed with an embodiment of the method described above.

Since the cross section along which half bodies 800 and 801 are assembled is along the E-plane (See FIG. 1*b*), the directional coupler so manufactured may have better performance than directional couplers not manufactured with the same method because this method avoids cutting through surface current lines.

Further, since in the embodiment shown, the aperture on the septum is not completely contained in a wall of only one of half body 800 or 801, standard technologies of removing the material such as milling may be used to form the walls. An aperture in one of the wall of half body 800 or half body 801 would considerably add complexity to the manufacturing method, likely leading to less precisions or higher manufacturing costs. Directional couplers 100, 101, 102 described above may be manufactured with method 700.

The selected material may be any metal suitable for the specific application, for example aluminum, silver plated aluminum, copper, nickel, silver plated invar or the like. For example for high frequency applications, silver plated aluminum may show a good compromise between mass density, electrical and thermal conductivity of the directional coupler and structural stiffness.

The selected material may comprise also plastic. For example, metal plated plastic may be used. Metal plated plastic is particularly advantageous for reducing payload mass in space missions.

It should be noted that the above-mentioned embodiments illustrate rather than limit the invention, and that those skilled in the art will be able to design many alternative embodiments.

In the claims references in parentheses refer to reference signs in drawings of embodiments or to formulas of embodiments, thus increasing the intelligibility of the claim. These references shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. An E-plane directional coupler for coupling an electromagnetic signal from an open end of the directional coupler to a plurality of open ends of the directional coupler, the directional coupler comprising:

two hollow bodies forming two waveguide portions, each hollow body having an open end arranged at a first side of the hollow body and another open end arranged at a second side of the hollow body opposite to the first side in a longitudinal direction of the hollow body, the hollow body having a first cross section perpendicular to the longitudinal direction, a second cross section along the longitudinal direction for defining an E-plane of propagation of the electric field, wherein the two waveguide portions have a common wall along the longitudinal direction forming a septum between the two waveguide portions on a second plane orthogonal to the E-plane, and wherein the septum includes an aperture for coupling the two waveguide portions, the aperture having a shape comprising a slanted part with respect to the longitudinal direction to couple part of a power of the electromagnetic signal, which is coupled into the directional coupler at an open end of a first one of the two waveguide portions and which has a fundamental mode of propagation with a half-wave pattern across a width of the first waveguide portion via the aperture into a second one of the two waveguide portions to excite an orthogonal mode of propagation of the electromagnetic signal with a half-wave pattern across a height of the second waveguide portion.

2. The directional coupler according to claim 1, wherein the slanted part has a staircase, saw tooth, spline or polynomial shape.

3. The directional coupler according to claim 1, wherein the shape of the aperture is reflection asymmetric with respect to the E-plane.

4. The directional coupler according to claim 1, wherein the waveguide portions are configured to each have a rectangular or semi-circular or semi-elliptical first cross section and a rectangular second cross section.

5. The directional coupler according to claim 4, wherein each hollow body forms a rectangular waveguide having rectangular first walls and rectangular second walls parallel to the E-plane and narrower than the first walls, and wherein the slanted part partially or completely extends between the second walls.

6. The directional coupler according to claim 1, wherein said slanted part has a first slope and the shape of the aperture comprises another slanted part with respect to the longitudinal direction, the other slanted part having a second slope opposite to the first slope.

7. The directional coupler according to claim 1, wherein the septum is arranged such that the two waveguide portions have identical first cross sections.

8. The directional coupler according to claim 1, wherein the shape of the aperture is reflection symmetric relative to a symmetry plane orthogonal to the E-plane and cutting the two waveguide portions in two identical waveguide subportions.

9. The directional coupler according to claim 1, comprising at least a further hollow body forming a further waveguide portion, wherein one of the two waveguide portions and the further waveguide portion includes a further common wall along the longitudinal direction forming a further septum between the waveguide portion and the further waveguide portion on the second plane, and wherein the further septum includes a further aperture for coupling the further waveguide portion to said waveguide portion, the further aperture having a further shape comprising a further slanted part with respect to the longitudinal direction.

10. The directional coupler according to claim 9, wherein the further shape of the further aperture is identical to the shape of the first mentioned aperture, and wherein the further septum is rotated on the second plane of 180 degrees with respect to the first mentioned septum.

11. A radio frequency waveguide network comprising one or more directional couplers, wherein at least one of the directional couplers is the directional coupler according to claim 1 for coupling the electromagnetic signal from an open end of the radio frequency waveguide network to another network open end of the radio frequency waveguide network.

12. The radio frequency waveguide network according to claim 11, wherein the at least one directional coupler of the network has, in use, the open end of one waveguide portion configured to receive the electromagnetic signal, the other open end of the waveguide portion configured to output a first electromagnetic signal coupled to the electromagnetic signal, the further open end of the other waveguide portion arranged at the same side of the other open end configured to output a second electromagnetic signal coupled to the electromagnetic signal, and wherein the shape of the aperture is arranged to induce an absolute phase difference between the first electromagnetic signal and second electromagnetic signal of substantially 90 degrees.

13. The radio frequency waveguide network according to claim 11, wherein the first electromagnetic signal has a first electromagnetic signal power and the second electromagnetic signal has a second electromagnetic signal power, and wherein the shape of the aperture is arranged for obtaining a predetermined power ratio of the second electromagnetic signal power to the first electromagnetic signal power.

14. The radio frequency waveguide network according to claim 12, wherein the shape of the aperture is arranged for obtaining a predetermined power ratio substantially equal to one.

15. A method of manufacturing the directional coupler according to claim 1, comprising:

(a) providing two half solid bodies made of a selected material, (b) removing the material from each half solid body for leaving a cavity and walls protruding from the cavity produced by the removed material, the walls being aligned along a longitudinal direction of the half body, the cavity extending from a first side of the half body to a second side of the half body opposite to the first side in the longitudinal direction, the cavity having an open side along the longitudinal direction of each half body, the two half solid bodies having equal cross sections perpendicular to the longitudinal direction, (c) after removing the material, assembling the two half bodies along the open side such that the walls of one half body are joined to the walls of the other half body on a single plane for forming two waveguide portions having a common wall between the two waveguide portions on a plane orthogonal to the single plane, wherein at least one of the walls which protrudes from the cavity and which is joined to form the common wall has a side edge having a slanted part with respect to the longitudinal direction for forming an aperture in the common wall, the aperture coupling the two waveguide portions and having thereby a shape comprising the slanted part with respect to the longitudinal direction.

* * * * *